US007464837B2

(12) United States Patent
Hoskins

(10) Patent No.: US 7,464,837 B2
(45) Date of Patent: Dec. 16, 2008

(54) HYDRATION DELIVERY TUBE SYSTEM

(75) Inventor: Matthew W. Hoskins, Bend, OR (US)

(73) Assignee: Mazama Designs, LLC, Bend, OR (US)

( * ) Notice: Subject to any disclaimer, the term of this patent is extended or adjusted under 35 U.S.C. 154(b) by 501 days.

(21) Appl. No.: 11/121,871

(22) Filed: May 3, 2005

(65) Prior Publication Data

US 2005/0251090 A1 Nov. 10, 2005

Related U.S. Application Data

(60) Provisional application No. 60/567,519, filed on May 4, 2004.

(51) Int. Cl.
*A45F 3/16* (2006.01)

(52) U.S. Cl. ..... 222/175; 222/530; 224/148.2

(58) Field of Classification Search ..... 222/175, 222/530; 224/148.1, 148.2, 148.4, 148.5; 239/152–154
See application file for complete search history.

(56) References Cited

U.S. PATENT DOCUMENTS 5,722,573 A * 3/1998 Carnel ..... 224/148.2
5,803,333 A * 9/1998 Fawcett ..... 224/652
5,913,456 A * 6/1999 Dikeman ..... 222/95
5,975,387 A * 11/1999 Gleason et al. ..... 224/148.2
6,055,975 A * 5/2000 Gallagher et al. ..... 124/50
6,199,729 B1 * 3/2001 Drzymkowski ..... 224/148.2
6,598,770 B2 * 7/2003 Bolts ..... 224/148.2
6,666,360 B1 * 12/2003 Swank ..... 224/148.2
2007/0181616 A9 * 8/2007 Horito et al. ..... 224/148.2

* cited by examiner

*Primary Examiner*—J. Casimer Jacyna
(74) *Attorney, Agent, or Firm*—Klarquist Sparkman, LLP

(57) ABSTRACT

The present invention relates to personal hydration systems. The personal hydration system comprises a first chamber, a second chamber, and a delivery tube. The delivery tube is housed within the second chamber, and one end of the delivery tube is connected to the first chamber. A retraction member is connected at one end to the first or second chamber. The other end of the retraction member is connected to the delivery tube. A user accesses the fluid in the hydration system by pulling the delivery tube out of the second chamber through an opening, drinking the fluid through a mouthpiece and then releasing the delivery tube. The retraction member automatically causes the delivery tube to be retracted back into the second chamber. The system also includes a tether for preventing the delivery tube from being pulled too far.

13 Claims, 3 Drawing Sheets

HYDRATION DELIVERY TUBE SYSTEM

CROSS-REFERENCE TO RELATED APPLICATIONS

This application claims the benefit of U.S. Provisional Application No. 60/567,519, which was filed on May 4, 2004.

BACKGROUND OF THE INVENTION

1. Technical Field

The present invention relates to personal hydration systems and more particularly, the delivery tube and fluid carrying pack portion of such systems.

2. Field of the Invention

Sufficient hydration is important for replacing bodily fluids during extended periods of aerobic activity. Currently, several methods are known for getting fluids to a person engaged in aerobic activity and in need of fluid replenishment.

It is desirable to make replenishment fluid available without the need for slowing or stopping aerobic activity. Water bottles carried by persons engaged in aerobic activity represent a method of providing fluid replacement on the go. However, water bottles are awkwardly shaped for carrying. Further, the use of one or both hands is required to drink from a water bottle. Many water bottles require opening of a cap or valve before they can be drunk from. These same bottles must be tipped upward for fluid delivery, an action that can distract the user from their activity. Water bottles with straws are also employed, but the suction action required for drawing fluid from the bottle is not compatible with aerobic activity. Therefore, the use of water bottles is not an ideal solution for fluid replenishment during physical activity.

In an attempt to overcome the deficiencies of water bottles, hydration systems have been developed that include a flexible reservoir for holding fluid, a flexible tube for conveying the fluid from the reservoir to the person engaged in aerobic activity, and a mouthpiece such as a manual valve, mouth-operated bite valve, or pump attached to the end of the tube. When it is desired to replenish fluids, the person engaged in aerobic activity places the outlet of the mouthpiece in his or her mouth and activates fluid flow from the reservoir into the person's mouth. Hydration systems of this type include backpack, shoulder pack, and waistpack style carrying pouches.

Hydration systems greatly facilitate fluid delivery and these systems have been adopted by individuals engaged in a wide range of sports and recreation activities. Despite the many advances in hydration pack design, retrieval of the mouthpiece during activity is often inconvenient due to the length and position of the delivery tube. In backpack style hydration systems the tube is typically placed over one shoulder and may be secured to the pack's shoulder strap. Engagement of the mouthpiece requires grasping the mouthpiece or tube with one hand and then directing it to the mouth. Frequently, the hydration pack wearer's eyes and hands are busy at the task at hand and the extra time and attention required to locate the mouthpiece tube end can be a distraction.

Waistpack hydration systems have great appeal as they are less encumbering than a backpack. Delivery tube location is a problem in waistpack systems as the tube must have enough length to reach from reservoir at the user's lower back region to their mouth, yet this length of tubing is not easily repositioned onto the waistpack when the user is finished drinking.

It would be desirable to have made available a hydration pack system that features a fluid delivery tube design that can be easily located and grasped with minimal interference to the wearer's activity. Ideally, such a system would be lightweight and comfortable for the user to wear during physical activities. Furthermore, it would be desirable for such a system to protect the fluid within the delivery tube and mouthpiece from temperature extremes.

BRIEF SUMMARY OF THE INVENTION

The present invention provides a retracting delivery tube system for use in a personal hydration system. Generally stated, the hydration delivery tube system consists of a fluid delivery tube with mouthpiece, and a retraction member connected to the fluid delivery tube. The fluid delivery tube is connected to a fluid reservoir, such as a polyurethane bladder, plastic laminate pouch or polyethylene container. The hydration delivery tube system and reservoir can be placed into a wearable pack so that the delivery tube can be accessed through an opening and/or channel incorporated into the pack. The pack may be made of weatherproof outer fabrics such as nylon Cordura, and/or weather resistant stretchable insulating fabrics such as Spandura, Schoeller Dryskin, Lycra, and neoprene. The delivery tube is of sufficient length to reach from its position in the pack to the pack wearer's mouth. The delivery tube is connected somewhere along its length to the first end of a retraction member. The retraction member's second end is anchored at a fixed point and is in tension with respect to the fluid delivery tube. The elastic member's second end is anchored to the pack or fluid reservoir such that the pack wearer's action of moving the delivery tube closer to their mouth acts in opposition to the tension on the retraction member. The retraction member stretches as the delivery tube is pulled upwards. When the pack wearer releases the delivery tube, the tensioned retraction member will draw the delivery tube back to its original position. The retraction member is preferably an elastic shock cord, but may also be a spring reel, latex or silicone cord or tube, elastic webbing or tension coil spring. The delivery tube may be made of PVC, polyurethane, TPE (thermoplastic elastomer), silicone, polyethylene or other similar flexible material.

In one embodiment the hydration delivery tube system includes the fluid delivery tube, mouthpiece, and retraction member integrated together with a fluid reservoir chamber and a second adjoined enclosure designed to house the delivery tube. The delivery tube is connected in communication with the fluid reservoir chamber and a portion of its length is contained within the delivery tube housing. The delivery tube housing features an exit port allowing the delivery tube to be drawn from its housing. The delivery tube housing is constructed to facilitate movement of the delivery tube. Ideally, the delivery tube is coiled in a single coil within the delivery tube housing with the mouthpiece end exiting out the opening in the tube housing. The retraction member is fixedly attached at its first end to the delivery tube near the mouthpiece. The retraction member is also linked at point near the apex of coiled portion of the delivery tube. This linkage is fixed to the delivery tube, but merely encircles the retraction member, allowing movement of the retraction member. Preferably, this linkage may be constructed in the form of a sheath that houses and insulates the delivery tube and retraction member. The delivery tube sheath may be constructed of a material such as foam rubber, fabric, PVC tube, tubular nylon webbing, neoprene sheath, polyurethane tube, nylon tube, Teflon tube, polyethylene tube, polyester tubular braid or plastic. Alternately, the delivery tube may be a coextruded plastic segment that includes channels for fluid flow and for the elastic member respectively. The flexible delivery tube sheath is fixedly attached to the delivery tube while the retraction member is free to stretch and move within the sheath. The second end of the retraction member exits the delivery tube sheath and is attached to the fluid reservoir/tube housing assembly opposite the delivery tube exit port. The arrangement of the delivery tube coil and retraction member is such that the tensioned retraction member holds the delivery tube in its coiled position. In use, traction on the mouthpiece end of the delivery tube causes the delivery tube to uncoil against the pulling force of the retraction member. The retraction member is of sufficient stretchability that it allows the desired extension of the delivery tube while at the same time providing a retracting force. Once the user completes the action of drawing the delivery tube and mouthpiece close to their mouth and releases the tube, the retraction member's pulling force retracts the delivery tube back into its coiled position.

In a preferred embodiment the hydration pack with fluid delivery tube system includes a wearable pack with a first chamber for holding a fluid reservoir and a second chamber designed to contain the delivery tube. The first chamber is constructed to securely hold the fluid reservoir and features openings to allow for filling and cleaning of the fluid reservoir. The fluid reservoir is connected to a fluid delivery tube that terminates in a mouthpiece. The delivery tube is of sufficient length to reach from the lower back of a user to their mouth. Between the first and second pack chambers there is a delivery tube passageway allowing the threading of the delivery tube from the fluid reservoir to second chamber. The delivery tube is housed within a flexible outer sheath that also houses a length of elastic shock cord. The elastic cord runs in parallel with the delivery tube within the flexible outer sheath. The inside and outside surface of the delivery tube sheath are of a low-friction nature. The elastic shock cord within delivery tube sheath is secured on one end at the mouthpiece area of the delivery tube. The elastic shock cord's other end is connected to the pack itself at a location within the second pack chamber.

The second chamber features an opening sized for access to the delivery tube's mouthpiece end. The delivery tube is positioned within the second chamber, such that the mouthpiece end is located at this opening. The shock cord to pack connection is located roughly opposite this opening. This connection includes a cord lock mechanism that allows tensioning of the shock cord. The inner surface of the second chamber is also of a low-friction nature. The delivery tube sheath and second chamber covering may also feature insulating materials as part of their make-up.

In use, the pack is designed to fit the user so that the user is as unencumbered as possible, while still carrying the necessary amount of fluid for hydration. The fluid reservoir and delivery tube are held securely within the pack while the user pursues their chosen activity. The delivery tube mouthpiece is located at an opening in the second pack chamber and can be positioned within easy reach of the user. The shock cord within the delivery tube sheath is tensioned so that the delivery tube mouthpiece is held in place at this access point. When the user needs to drink, they grasp the mouthpiece end of the delivery tube and pull it towards their mouth. As they do so, the shock cord stretches within the delivery tube sheath providing gentle traction on the delivery tube. Once the user is finished drinking, they release the delivery tube, and the spring-force of the stretched shock cord pulls the tube and mouthpiece back to their original location within the pack.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

The drawings are for illustrative purposes only and are not drawn to scale. In the drawings, the same numbers are used for the same part or portion throughout the drawings.

DETAILED DESCRIPTION OF THE INVENTION

Figure 1:
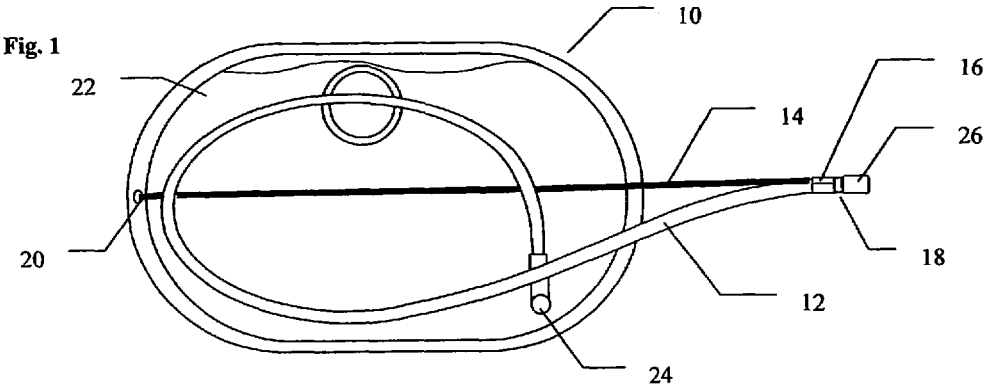
FIG. 1 is a front view of the hydration delivery tube system.

FIG. 1 shows a hydration delivery tube system 10 that includes a fluid delivery tube 12 and retraction member 14 according to the present invention. In this embodiment, the retraction member is an elastic cord. The fluid delivery tube 12 is attached to the first end 16 of the elastic member 14 near the distal end 18 of the fluid delivery tube. The second end 20 of the elastic member is connected to fluid reservoir 22. The fluid delivery tube 12 is in communication with a fluid reservoir 22. The delivery tube 12 is attached at one end to the fluid reservoir 22 via fitting 24. A valved-mouthpiece 26 is mounted on the distal end 18 of delivery tube 12.

Figure 2:
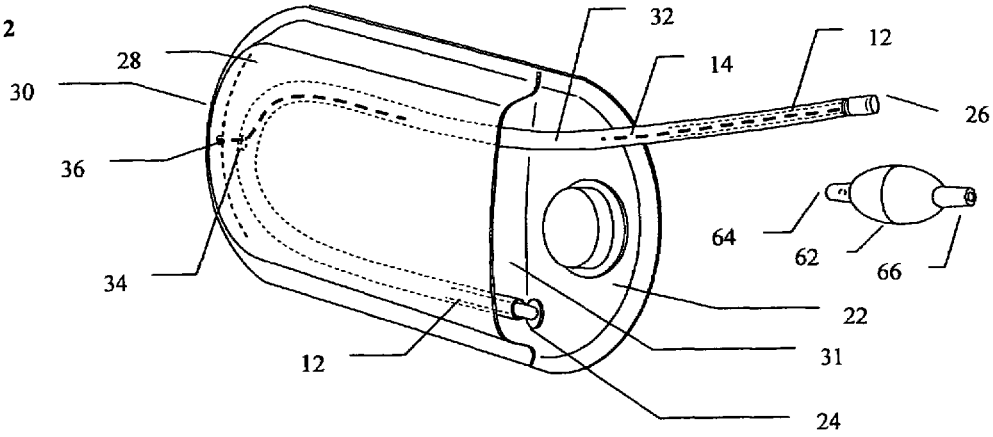
FIG. 2 is a perspective view of one embodiment of the hydration delivery tube system.

FIG. 2 shows an alternative embodiment of the hydration delivery tube system. In this example delivery tube housing 28 adjoins the fluid reservoir 22 to create a tube housing/fluid reservoir assembly 30 that is incorporated into a wearable pack. Opening 31 allows delivery tube access. The tube housing 28 provides an unencumbered space for delivery tube 12 movement and storage. A flexible sheath 32 houses delivery tube 12 over a portion of or all of its length. Flexible sheath 32 contains delivery tube 12 in such a way that flexible sheath 32 is restricted from moving relative to delivery tube 12. Elastic member 14 is housed along some portion of its length within flexible sheath 32 and is free to stretch within the flexible sheath 32. Elastic member 14 exits flexible sheath 32 at an exit location 34 and then continues to an attachment point 36 on delivery tube housing/fluid reservoir assembly 30.

The mouthpiece 26 may be a valve, bite valve, squeeze bulb pump or other manual or powered pump. For example, the valved-mouthpiece 26 shown in FIG. 2 may be replaced with a squeeze bulb pump 62. A first end 64 of the pump would be connected to the delivery tube 12 and equipped with a check valve so that fluid may flow into the bulb 62 through the first end 64, but not out of the bulb 62 through the first end 64. A second end 66 of the pump is an outlet equipped with a mouthpiece. Squeezing the bulb 62 forces liquid from the bulb 62 out through the mouthpiece on the second end 66 of the squeeze bulb 62. Upon releasing the bulb 62, the bulb 62 returns to its original volume, creating a vacuum in the interior of the bulb 62 and drawing liquid from the delivery tube 12 into the bulb 62.

Figure 3:
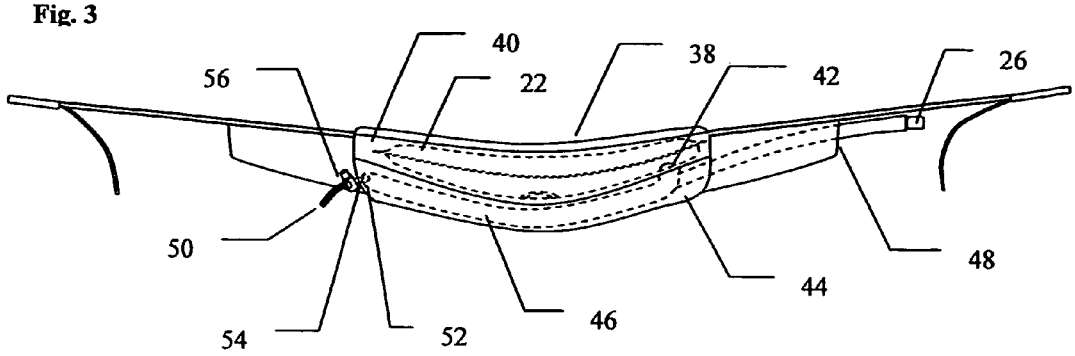
FIG. 3 is a top view of a second embodiment of the hydration delivery tube system.
Figure 4:
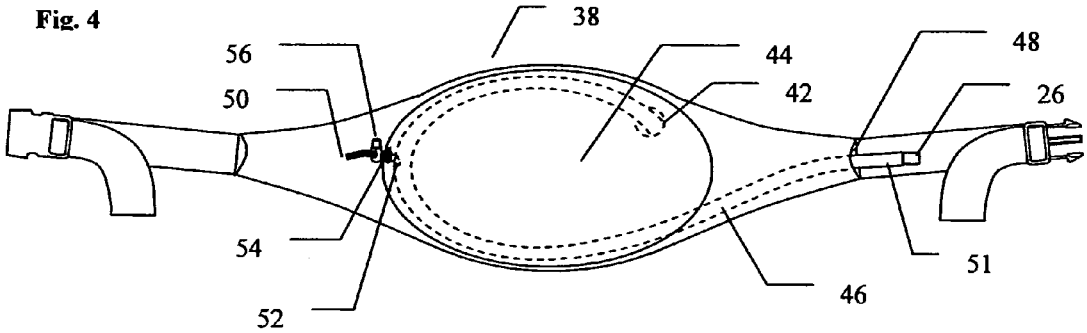
FIG. 4 is a front view of a second embodiment of the hydration delivery tube system.
Figure 5:
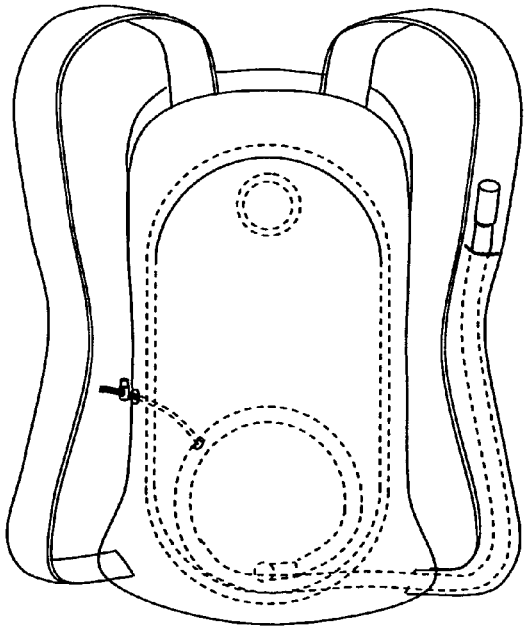
FIG. 5 is a front view of a third embodiment of the hydration delivery tube system.

In FIGS. 3 and 4, another embodiment of the invention includes the retracting fluid delivery system integrated into a waistpack 38. In this embodiment, fluid reservoir 22 is held in a first chamber 40 within the pack. Fluid delivery tube passes out a delivery tube passageway 42 into a second chamber 44. Second chamber 44 is sized to allow flexible sheath assembly 46 to coil up within the second chamber 44. The flexible sheath assembly consists of the delivery tube and elastic member housed within a flexible sheath as described above. The flexible sheath assembly 46 passes out access opening 48. Elastic member consists of shock cord 50 which is attached to the flexible sheath assembly at the mouthpiece end 51, then exits the flexible sheath assembly at opening 52. Shock cord 50 then passes through a loop 54 connected to waistpack 38. After passing through loop 54, shock cord 50 is threaded through cord lock 56 to provide a means of tensioning shock cord 50. The embodiment shown in FIG. 5 is similar to the embodiment shown in FIGS. 3 and 4, except that the hydration pack is in the form of a backpack rather than a waistpack.

Figure 6:
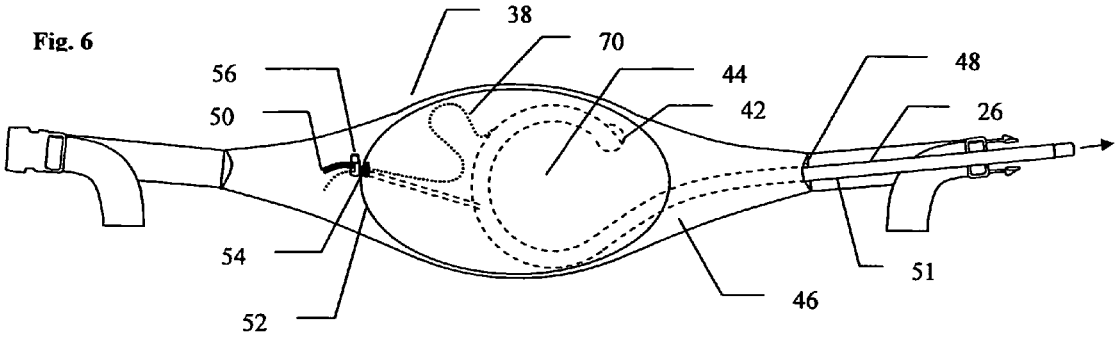
FIG. 6 is a front view of the preferred embodiment of the hydration delivery tube system.

In FIG. 6, a preferred embodiment of the invention includes a tether 70. The tether 70 is a non-elastic cord connected to the flexible sheath assembly 46 at one end and to the second chamber 44 at the other end. Alternatively, the other end of the tether 70 could be connected to the first chamber 40. The tether 70 prevents the flexible sheath assembly 46 from being pulled out too far. The length of the tether 70 can be adjusted to limit how far the flexible sheath assembly 46 can be pulled.

While the invention has been described by reference to the preferred embodiments described above those skilled in the art will recognize that the invention as described and illustrated can be modified in arrangement and detail without departing from the scope of the invention.

What is claimed is:

1. A personal hydration system comprising:

a fluid reservoir configured to contain a fluid;

a delivery tube having a first end portion and a second, distal end portion, the first end portion being fluidly connected to the fluid reservoir to allow fluid contained in the reservoir to flow outwardly through the delivery tube to a user's mouth;

an enclosure coupled to the reservoir and sized to house at least a portion of the delivery tube in a retracted position, wherein the delivery tube can be pulled to an extended position wherein a length of said portion of the delivery tube extends from the enclosure;

a resilient retraction member having first and second end portions, the first end portion of the retraction member being connected to the distal end portion of the delivery tube and the second end portion of the retraction member being connected at a fixed location relative to the enclosure such that when the delivery tube is pulled outwardly to the extended position and then released by the user, the retraction member applies a pulling force on the delivery tube that pulls the delivery tube back toward the retracted position; and a flexible sheath, wherein a portion of the delivery tube and a portion of the retraction member are housed within the flexible sheath, the sheath maintaining said portion of the retraction member in a position extending along the length of said portion of the delivery tube housed within the flexible sheath.

2. The personal hydration system of claim 1, wherein the second end portion of the delivery tube comprises a valved mouth piece.

3. The personal hydration system of claim 1, wherein the second end portion of the retraction member is attached to or adjacent the enclosure.

4. The personal hydration system of claim 1, wherein the second end portion of the delivery tube is accessible through an opening in the enclosure.

5. The personal hydration system of claim 1, wherein the sheath is secured to the delivery tube such that the sheath and the delivery tube move together into and out of the enclosure when the delivery tube is moved between its extended and refracted positions, and the portion of the retraction member is able to stretch and move within the flexible sheath.

6. The personal hydration system of claim 1, wherein the second end portion of the delivery tube comprises a squeeze bulb pump.

7. The personal hydration system of claim 1, wherein the system further comprises a tether.

8. The personal hydration system of claim 1, wherein the system further comprises a tether, wherein a first end of the tether is connected at a fixed location relative to the enclosure and the second end of the tether is connected to the flexible sheath, the tether having a length that prevents the delivery tube from being pulled outwardly from the enclosure beyond a predetermined distance.

9. The personal hydration system of claim 1, wherein the retraction member is an elastic cord.

10. The personal hydration system of claim 1, wherein a length of the retraction member extends outwardly from the sheath at a location intermediate the first and second end portions of the delivery tube, said length including the second end portion of the retraction member, wherein the second end portion of the retraction member is secured at a fixed location relative to the enclosure such that a portion of the delivery tube assumes a coiled position inside the enclosure when the delivery tube is retracted.

11. The personal hydration system of claim 1, wherein the system is in the form of a waistpack configured to be worn around the waist of the user.

12. A personal hydration system comprising:

fluid reservoir configured to contain a fluid;

a delivery tube having a first end portion and a second, distal end portion, the first end portion being fluidly connected to the fluid reservoir to allow fluid contained in the reservoir to flow outwardly through the delivery tube to a user's mouth;

an enclosure coupled to the reservoir and sized to house a majority of the length of the delivery tube in a retracted position, wherein the delivery tube can be pulled to an extended position wherein at least a portion of said length of the delivery tube extends outwardly from the enclosure; and a resilient retraction member comprising an elastic cord having first and second end portions, the first end portion of the cord being connected to the distal end portion of the delivery tube, the cord having a portion that extends along the length of the delivery tube, the cord having another portion including the second end portion of the cord that extends away from the delivery tube at a location intermediate the first and second end portions of the delivery tube, the second end portion of the cord being connected at a fixed location relative to the enclosure such that when the delivery tube is pulled outwardly to the extended position and then released by the user, the cord applies a pulling force on the delivery tube that causes a portion of the delivery tube to form a coil in the enclosure when the delivery tube is retracted.

13. A personal hydration system comprising:

fluid reservoir configured to contain a fluid;

a delivery tube having a first end portion and a second, distal end portion, the first end portion being fluidly connected to the fluid reservoir to allow fluid contained in the reservoir to flow outwardly through the delivery tube to a user's mouth;

a flexible sheath covering a portion of the delivery tube;

an enclosure coupled to the reservoir and sized to house a majority of the length of the delivery tube and the sheath in a retracted position, wherein the delivery tube and the sheath can be pulled to an extended position wherein at least a portion of said length of the delivery tube and the sheath extend outwardly from the enclosure; and a resilient retraction member comprising an elastic cord having first and second end portions, the first end portion of the cord being connected to the distal end portion of the delivery tube, the cord having a portion that extends through the sheath, the sheath maintaining said portion of the cord in a position extending along the length of the delivery tube, the cord having another portion including the second end portion of the cord that extends outwardly from the sheath at a location intermediate the first and second end portions of the delivery tube, the second end portion of the cord being connected at a fixed location relative to the enclosure such that when the delivery tube and sheath are pulled outwardly to the extended position and then released by the user, the cord applies a pulling force on the delivery tube and sheath that causes a portion of the delivery tube to form a coil in the enclosure when the delivery tube is retracted.

* * * * *